United States Patent [19]

Gerhardy

[11] 4,455,266

[45] Jun. 19, 1984

[54] CARBURETOR FOR INTERNAL COMBUSTION ENGINES, ESPECIALLY VERY SMALL PORTABLE ENGINES

[75] Inventor: Reinhard Gerhardy, Korb, Fed. Rep. of Germany

[73] Assignee: Firma Andreas Stihl, Waiblingen, Fed. Rep. of Germany

[21] Appl. No.: 396,742

[22] Filed: Jul. 9, 1982

[30] Foreign Application Priority Data

Jul. 11, 1981 [DE] Fed. Rep. of Germany ..... 3127516

[51] Int. Cl.[3] ..... F02M 17/04

[52] U.S. Cl. ..... 261/35; 261/DIG. 68; 261/DIG. 8

[58] Field of Search ..... 261/DIG. 68, 35, DIG. 8

[56] References Cited

U.S. PATENT DOCUMENTS

| | | | |
|---|---|---|---|
| 3,037,751 | 6/1962 | Phillips | 261/DIG. 68 |
| 3,181,843 | 5/1965 | Brown et al. | 261/DIG. 68 |
| 3,265,050 | 8/1966 | Tuckey | 261/DIG. 68 |
| 3,441,010 | 4/1969 | Barr et al. | 261/DIG. 68 |
| 3,473,254 | 7/1973 | Tuckey | 261/DIG. 68 |
| 4,159,012 | 6/1979 | Pizzuto et al. | 261/DIG. 68 |

FOREIGN PATENT DOCUMENTS 470646 8/1937 United Kingdom ..... 261/DIG. 68

*Primary Examiner*—Tim R. Miles

*Attorney, Agent, or Firm*—Walter Ottesen

[57] ABSTRACT

A carburetor for internal combustion engines, especially for very small portable engines. The carburetor has a control chamber arranged in the carburetor in the fuel supply to the intake pipe. The control chamber is connected with the intake pipe via inlet passages, the rate or quantity of flow through which can be regulated, and is connected with fuel feed supplied by a fuel pump via an inlet valve, which is biased in the closed position. The inlet valve is opened by a control membrane which delimits the control chamber. The control membrane, on that side thereof remote from the control chamber, delimits an equalizing chamber along with a closure cover fastened to the carburetor housing. The equalizing chamber is constructed as a pressure chamber which can be selectively connected via a reversing or change-over valve with either the crankcase housing of the internal combustion engine, or with the atmosphere.

8 Claims, 7 Drawing Figures

Fig.3
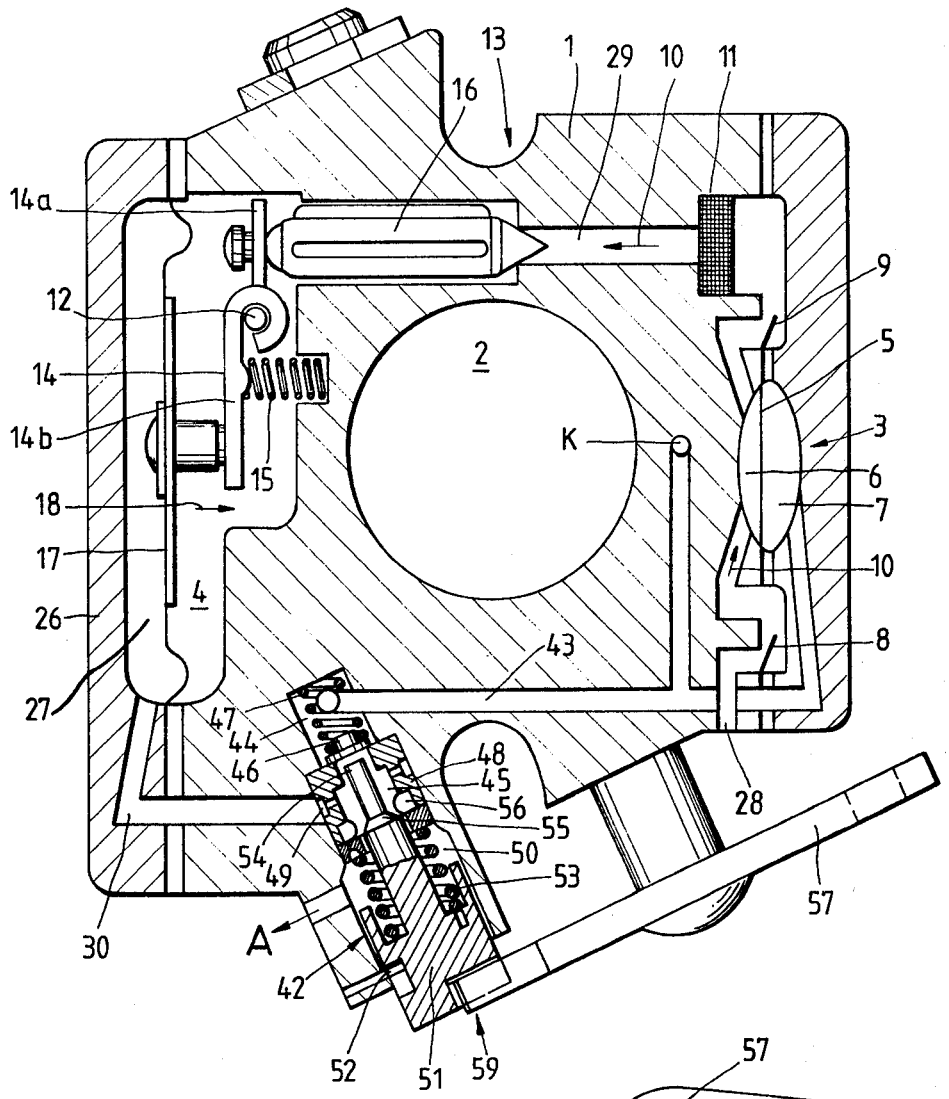
Fig.5
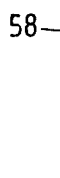
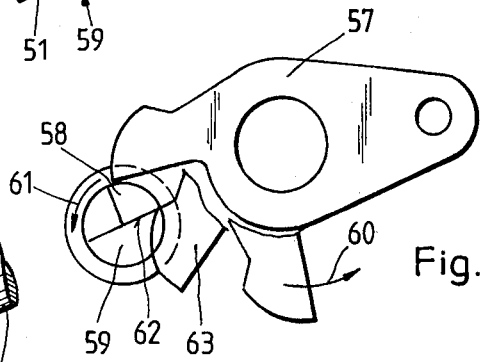
Fig.4

CARBURETOR FOR INTERNAL COMBUSTION ENGINES, ESPECIALLY VERY SMALL PORTABLE ENGINES

FIELD OF THE INVENTION

The present invention relates to a carburetor for internal combustion engines, especially for very small portable engines, and has a control chamber arranged in the carburetor in the fuel supply line to the intake or suction pipe; the control chamber is connected with the intake pipe via inlet passages, the rate or volume of flow through which can be regulated, and is connected with fuel supplied from a fuel pump via an inlet valve, which is biased in the closed position; the inlet valve is opened by a control membrane which delimits the control chamber; the control membrane, on that side thereof remote from the control chamber, delimits an equalizing chamber along with a closure cover or end plate fastened to the carburetor housing.

BACKGROUND OF THE INVENTION

Known carburetors of this type are so-called membrane or diaphragm carburetors and have a fuel pump driven by the pressure fluctuations in the crankcase housing of the internal combustion engine, so that the fuel is present under pressure at the inlet valve to the control chamber. The fuel present in the control chamber is drawn in through the inlet passages by the underpressure present in the inlet pipe of the carburetor, and is supplied along with the drawn-in air as a mixture to the combustion chamber.

An opening of the inlet valve for refilling the control chamber is always brought about when an underpressure exists in the control chamber because of the withdrawn fuel, with a consequence of such underpressure being a movement of the membrane or diaphragm. This underpressure must be so great that the force of the closure spring of the inlet valve can be overcome, whereby fuel present under pressure in the fuel supply line biases the inlet valve already in an opening direction. The membrane, on that side thereof remote from the control chamber, along with a part of the carburetor housing, forms an equalizing chamber which is connected with the atmosphere.

The rate or quantity of flow through the inlet passages to the intake pipe can be regulated by adjustment or set screws, whereby the fuel supply at idling speed is undertaken for adjustment with an adjustment screw especially provided for this purpose. Since the pressure in the intake pipe drops by approximately 50% and more during acceleration of the engine, a considerable reduction of the fuel supply occurs in the acceleration phase, so that the mixture is leaner, no clean filling of the combustion chambers is assured, and the internal combustion engine does not accelerate free of disturbance. In order to try to compensate for the fuel deficiency during acceleration, the mixture is made excessively rich during idling. This, however, requires an increased fuel consumption, and can additionally lead to deposits in the combustion chamber and on the sparkplug, which can lead to operating disturbances and functional sacrifices.

Furthermore, the rate or quantity of flow through the inlet passages must be adjusted in such a way that a reliable starting of the engine is assured. A choke is provided during the starting procedure for building-up a sufficient underpressure in the intake pipe especially with very small engines; this choke covers the entire intake pipe cross section. In this connection, the choke must be fitted so closely or tightly that a sufficient underpressure is built up which, however has as a consequence that the internal combustion engine, after starting, again dies or stops due to lack of air before it has been possible to open the choke. The correct setting of the idling adjustment together with the choke is consequently a matter of experience and requires a certain manual dexterity of the operator.

During hot starting there results the problem that with an open choke, the underpressure generated in the intake pipe cannot withdraw the vapor voids forming in the fuel supply line from the carburetor system. Also, this is not always satisfactorily possible with the choke closed, so that especially during hot starting considerable starting difficulties are encountered. Additionally, the danger of excessive richness of the fuel supply is encountered with the choke closed.

With the adjustment of the idling speed, care must be taken, especially with portable internal combustion engines, that even in unfavorable conditions the filling of the combustion chamber with the prepared mixture is ensured. A satisfactory acceleration of the internal combustion engine must be assured especially even in unfavorable operating conditions. Previously, it was attempted to anticipate or prevent a possible deficient fuel flow in unfavorable operating conditions by over-rich adjustment in normal conditions. A satisfactory solution, however, cannot be attained in this way, so that an acceleration of the engine is hardly possible in unfavorable operating conditions.

SUMMARY OF THE INVENTION

The carburetor according to the present invention is characterized primarily by constructing the equalizing chamber as a pressure chamber which can be selectively connected via a reversing or change-over valve either with the crankcase housing of the internal combustion engine, or with the atmosphere.

The pressure chamber is connected with the crankcase housing during starting of the engine, so that the inlet valve is opened in a defined manner, and the fuel which is present under the pressure of the fuel pump flows into the control chamber and through the inlet passages into the intake pipe without a considerable underpressure having to exist in the intake pipe. Consequently, a choke can be completely eliminated, so that the problems connected with the choke are also eliminated during starting of the internal combustion engine. The engine is easy to start in cold conditions as well as in hot conditions since sufficient fuel can always flow into the intake pipe because of the controlled or regulated opening times of the inlet valve. Also, possible vapor voids in the fuel supply line are quickly and reliably removed. By connecting the pressure chamber to the crankcase housing according to the present invention, a reliable fuel flow to the intake pipe is assured in all critical phases in which the intake pipe pressure is not sufficient for a disturbance-free fuel feed. Accordingly, a reliable starting and acceleration behavior of an internal combustion engine is attained with the connection according to the present invention. A disturbance-free operation of the internal combustion engine is now even assured in critical conditions. The pressure chamber is connected to the atmosphere in normal operation, so that the carburetor operates in a known manner.

In an especially advantageous embodiment, the reversing or change-over valve is integrated in the housing of the carburetor, whereby all passages can advantageously be arranged in the carburetor housing itself. The reversing or change-over valve is preferably actuatable by the throttle control rod, so that the operator need not perform any further manipulations.

According to specific embodiments of the present invention, the reversing or change-over valve may be held in a starting position, in which the pressure chamber is connected with the crankcase housing.

The reversing or change-over valve may be actuatable by means of a throttle control rod.

The reversing or change-over valve may be arranged in the carburetor housing. The head of a control bolt of the reversing or change-over valve may be partially located in the pivot range of an extension of the actuating lever of the throttle or butterfly valve. The reversing or change-over valve may comprise three valve chambers which open into each other and are located axially one behind the other, with a valve closing air tight and controlled by the control bolt being respectively arranged at the transition to the next valve chamber. The valve from the first valve chamber to the second valve chamber may comprise a valve closure member which is biased in the closing direction and is held against a valve seat arranged tightly in the second valve chamber; the valve between the second valve chamber and the third valve chamber may comprise a sealing ring arranged tightly in the second valve chamber, and a step or shoulder, of the control bolt, which acts as a valve closure member; the valves are alternately actuatable, and the first valve chamber is connected with the crankcase housing, the second valve chamber is connected with the pressure chamber, and the third valve chamber is connected with the atmosphere.

That end of the control bolt located across from the valve closure member may be constructed as an actuating push rod. The head of the control bolt may be located outside the carburetor housing and may have a stop or ledge corresponding to half the cross sectional surface of the head; that segment of the stop located in the pivot range of the extension of the actuating lever may have a slope which rises toward the inwardly located edge. The control bolt may be pivotable counter to a reset force in the circumferential direction, without axial displacement, by the extension of the actuating lever as it moves back in the direction of idling position.

BRIEF DESCRIPTION OF THE DRAWING

The invention will now be described with reference to the drawing wherein:

FIG. 3 is a cross section through a carburetor with an integrated reversing or change-over valve;

FIG. 4 is a plan view of the actuating lever of the throttle or butterfly valve, and the head of a control pin or bolt; and FIG. 5 is a side view of the head of the control pin shown in FIG. 4.

DESCRIPTION OF THE PREFERRED EMBODIMENTS OF THE INVENTION

Figure 1:
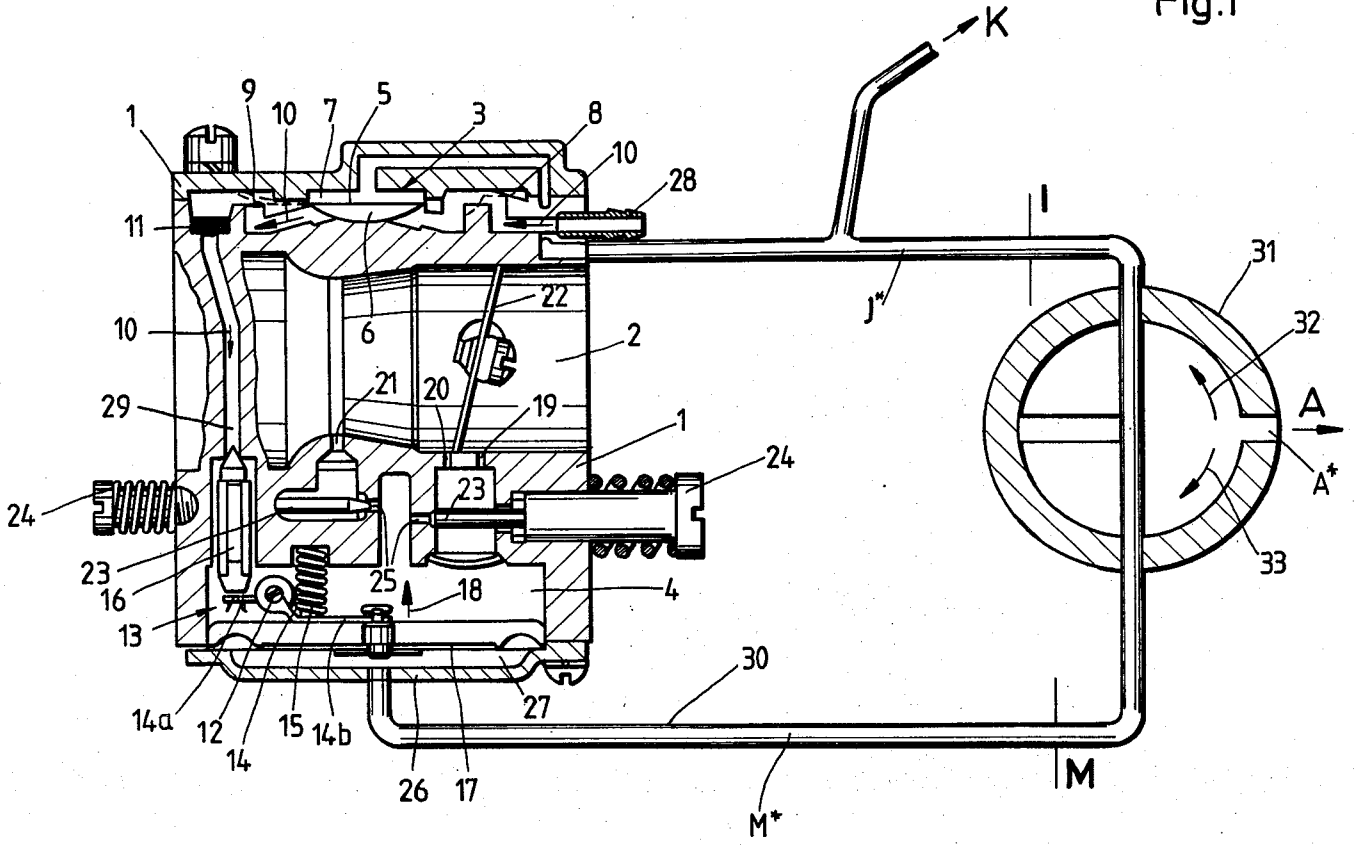
FIG. 1 is a cross section through one embodiment of the inventive carburetor with a schematically illustrated reversing or change-over valve.

Referring now to the drawings in detail, and in particular to FIG. 1, a fuel pump 3 and a control chamber 4 are arranged in the carburetor housing or body 1 around the centrally located intake or suction pipe 2.

The fuel pump 3 is constructed as a diaphragm pump. The diaphragm 5 separates a working chamber into a fuel feed chamber 6 and a pressure chamber 7. The fuel feed chamber 6 is protected by check valves 8,9 on the intake and outlet sides, so that a fuel flow in the direction of arrow 10 is assured during pumping of the diaphragm 5. The fuel feed chamber 6 is connected via a connection 28 with a non-illustrated fuel tank, while the pressure chamber 7 is connected with a line leading to the crankcase housing, as indicated by the arrow K. The pressure fluctuations encountered in the crankcase housing are thereby utilized for fuel feed in a manner known per se.

A fuel filter 11 is arranged in the fuel supply line 29 to the control chamber 4 for the purpose of filtering out contaminations possibly existing in the fuel. The fuel supply line 29 to the control chamber 4 is closed by an inlet or intake valve 13 which essentially comprises a double control lever or driving crank 14 which is pivotable about an axis 12; the first lever arm 14*a* of the double lever 14 holds an inlet-valve cone, and the second lever arm 14*b* thereof is connected with a membrane or diaphragm 17 which delimits the control chamber 4. A spring 15 engages the second lever arm 14*b* and applies a force which holds the inlet-valve cone 16 tightly in the fuel supply line. The membrane 17 effects an opening of the inlet valve 13 when it moves in the direction of arrow 18, with the double control lever 14 being pivoted counter to reducing the space of the control chamber 4, i.e. in the direction of the force of the spring 15, and the cone 16 opening the fuel supply line 29.

Three inlet passages 19, 20 and 21 proceeding from the control chamber 4 open into the intake pipe 2, whereby the inlet passage 19 is located on that side of the butterfly valve 22 which faces the combustion chamber, and forms the idling nozzle. Fuel is drawn into the intake pipe 2 in the partial throttle range from the adjacent inlet passage 20 in a known manner because of the changing pressure conditions when the butterfly valve 22 is pivoted. Fuel is also drawn into the intake pipe 2 in the full load range via the inlet passage 21 when the butterfly valve 22 is completely open.

The fuel flow to the intake pipe 2 can be adjusted by a flow volume regulator respectively comprising an axially adjustable nozzle or jet needle 23, and an opening 25 associated therewith through which the fuel flows from the control chamber 4 to the inlet passages 19, 20, 21. The nozzle needle 23 is adjustably held in the carburetor housing 1 by a setscrew or adjustment screw 24.

The membrane 17 of the control chamber 4, along with a closure cover 26 screwed to the carburetor housing 1, delimit a pressure chamber 27 located on that side of the membrane 17 remote from the control chamber 4. The pressure chamber 27 communicates with a reversing or change-over valve 31, preferably a three-way valve, via a pressurized line 30. The three-way valve is further connected with the crankcase housing via the line K, while the third connection opens into the atmosphere A.

The position of the three-way valve 31 illustrated in FIG. 1 connects the pressure chamber 27, via the pressure supply line of the crankcase housing, to the pressure chamber 7 of the fuel pump 3. When an internal combustion engine provided with a carburetor according to the present invention is started, a positive pressure pulse simultaneously pressurizes the fuel in the fuel feed chamber 6, or in the fuel supply line 29, while the same pressure pulse acts in the pressure chamber 27 against the membrane 17, shifting the latter in the direction of arrow 18, so that the inlet valve 13 is opened via the double lever 14, and the fuel under pressure can flow into the control chamber 4 and out through the inlet passage 19 without the necessity for considerable underpressure in the intake pipe. In this way, the enriched mixture necessary for starting is supplied to the combustion chambers without having to generate an underpressure in the intake pipe through additional manipulations, for instance via a choke. A choke can consequently be entirely eliminated with the inventive carburetors.

A sufficiently enriched mixture for the starting and accelerating phases of the internal combustion engine is attained in the illustrated FIG. 1 position of the reversing or changeover valve 31, which is preferably pivotable respectively by only 90° in one of the directions represented by the arrows 32, 33, with the sufficiently enriched mixture being attained for this operating state by the defined opening times of the inlet valve 13 and the necessarily following flow of fuel. Also during sudden accelerations, i.e. when the butterfly valve 22 is opened, there is assured that the combustion mixture does not become leaner. Independently of the position of the internal combustion engine, the inventive linkage of the pressure chamber 27 to the pressure pulse in the crankcase housing assures that in every operating condition of the engine a correct mixture is supplied to the combustion chambers.

Figure 2A:
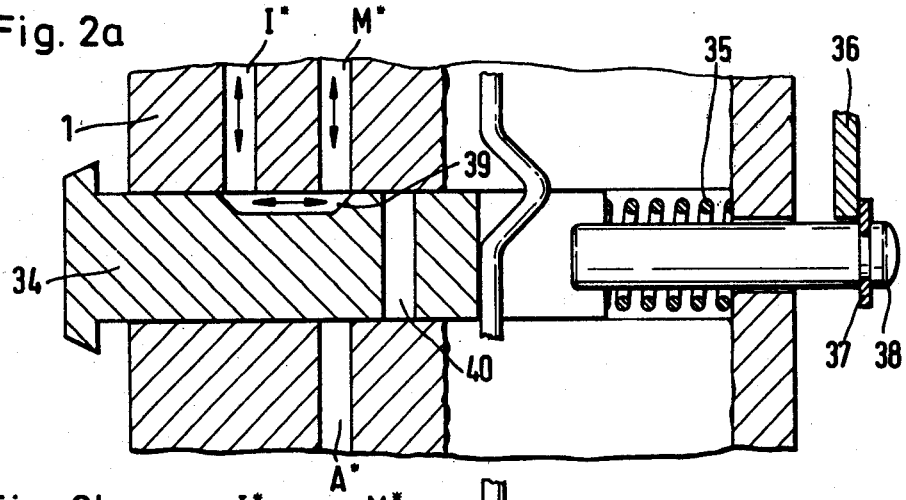
FIGS. 2*a*, 2*b* and 2*c* illustrate different positions of one embodiment of a reversing or change-over valve intended for installation in a carburetor housing.
Figure 2B:
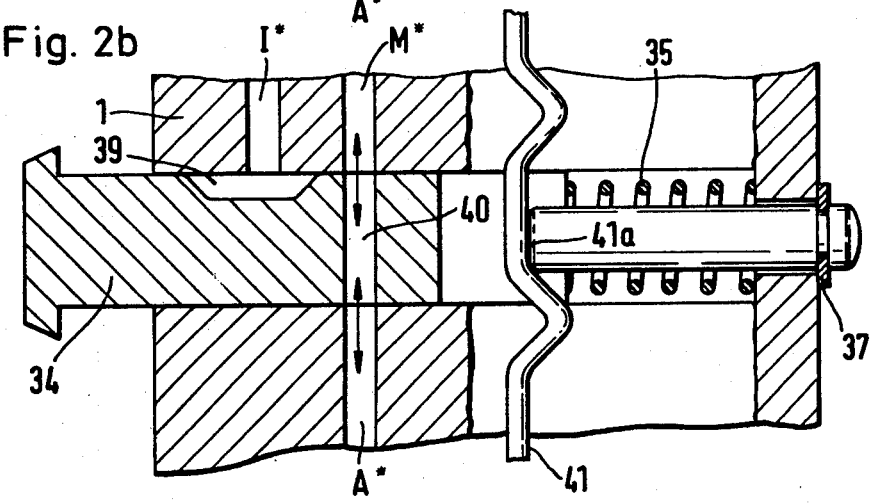
Figure 2C:
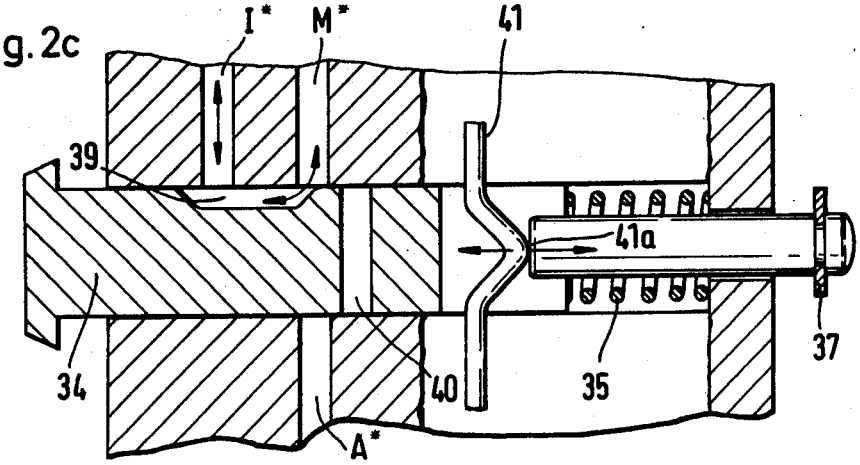

The adjustment of the mixture for idling speed can consequently be adjusted exclusively according to the idling behavior of the engine without having to take into consideration changes in position of the engine or acceleration behavior thereof, which is particularly true with the embodiments according to FIGS. 2 and 3, which will be described in the following paragraphs.

In a normal operating situation, i.e. after starting or accelerating the engine, the three-way valve 31 is pivoted in the direction of arrow 32, so that the pressure chamber 27 is connected with the atmosphere A, and the carburetor delivers the fuel for mixture formation in a known manner by the underpressure in the intake pipe 2.

Even during a hot start, the starting difficulties of fuel delivery occurring with known carburetors because of vaporlock no longer occur. Thus, the three-way valve 31 is again pivoted in the direction of arrow 33 during a hot start, so that the pulse I from the crankcase housing again connects with the membrane connection M of the pressure chamber 27. The vapor voids are quickly withdrawn through the inlet passages 19, 20, 21 as a result of the forced fuel feed of the fuel pump 3 and the defined opening of the inlet valve, and because of the pressure pulse upon the diaphragm 7, so that a hot start without problems is assured, especially because no choke is provided and thus sufficient air is available for combustion.

FIGS. *2a*, *2b* and *2c* show an embodiment of the three-way valve 31, the control piston 34 of which is arranged in the control knob for the gas supply. Passages I, M, A are arranged in the carburetor housing, whereby the passage I* conveys the pulse from the crankcase housing, the passage M* leads to the pressure chamber 27, and the passage A* is connected with the atmosphere. In the starting position according to FIG. *2a*, the control piston 34 is shifted against the force of a spring 35 into the carburetor housing 1. The control piston 34 is held in this position by a stop 36 which engages a retaining ring 37 which is seated on the piston end 38 projecting from the carburetor housing 1. In this position, a groove 39 in the control piston 34 connects the passage I* with the passage M*, so that the pressure pulse coming from the crankcase housing acts on the rear side of the membrane 17 and causes a defined opening of the inlet valve 13.

In the normal position according to FIG. *2b*, the groove 39 is shifted in such a way that the connection between the passage I* and the passage M* is interrupted. A bore 40 arranged in the control piston 34 now connects the passage M* directly with the passage A* to the atmosphere A, so that the pressure chamber 27 is connected to the atmosphere in a known manner.

The transition from the starting position according to FIG. *2a* to the normal position according to FIG. *2b* occurs automatically. Full power or full throttle is applied once after starting and running-up of the internal combustion engine, as a result of which the partial-gas stop 36 disengages from the retaining ring 37 in a manner not set forth in greater detail, so that the control piston 34 is shifted into the normal position thereof due to the action of the spring 35.

The throttle control rod 41 is advantageously operatively connected with the control piston 34 in such a way that during acceleration, the control piston 34 is shifted by the throttle control rod 41 in the direction of the starting position according to FIG. *2a*, so that, during the acceleration phase, the groove 39 at least partially and briefly connects the passages I* and M* with each other as shown in FIG. *2c*, whereby an enriched mixture is ensured during the acceleration phase. In shifting the control piston 34 to the position shown in FIG. *2c*, the control rod 41 is moved in the direction of its longitudinal axis and engages a cam surface 41*a* on the control piston 34 thereby displacing the piston 34 against the force of spring 35.

A carburetor with an integrated reversing or changeover valve 42 is illustrated in the cross sectional view of FIG. 3. The same reference numerals are used for identical parts. A first valve chamber 44 is connected with the pressure connection K to the crankcase chamber via a passage 43; the valve chamber 44 opens axially into a second valve chamber 45 via a valve. The valve closure member 46 of the valve is pressed against a valve seat by a spring 47 arranged in the first valve chamber 44; the valve seat is formed by a sleeve 48 arranged tightly or sealingly in the second valve chamber 45. The passage 30 of the pressure chamber 27 opens radially into the second valve chamber 45, for which purpose suitable radial openings 49 are provided in the sleeve 48.

The second valve chamber 45 opens axially into a third valve chamber 50, which is directly connected with the atmosphere A. A control pin or bolt 51 which is axially shiftable to a limited extent, and is rotatable to a limited extent in the peripheral or circumferential direction, is arranged in the valve chamber 50. The bolt 51 is fixed by a pin 52, which simultaneously forms the stop or abutment for the axial as well as the peripheral direction. The control bolt 51 is biased in the rest position by a spring 53, which simultaneously holds the sleeve 48 in position in the second valve chamber 45. The ends of the spring 53 are respectively non-rotatably fastened at their supports, so that the spring 53 is also effective as a return spring in the peripheral or circumferential direction of the control bolt 51.

The control bolt 51 is stepped, whereby the smaller diameter end 54 thereof, located opposite the valve closure member 46, is provided as an actuating stem or push rod, while the step or shoulder 55 forms a second valve relative to the remaining body of the control bolt 51 together with a sealing ring 56 arranged in the sleeve 48, which second valve can close the axial connection air tight between the second valve chamber 45 and the third valve chamber 50.

The head 59 of the control bolt 51 is located outside the carburetor housing 1, with at least a portion of the head 59 being located in the pivot region of an actuating lever 57 of a throttle or butterfly valve (not shown in FIG. 3). As shown in FIGS. 4 and 5, the head 59 has a first slope or bevel 58 upon which an extension of the actuating lever 57 slides or moves during pivot movement in the direction of arrow 60, whereby the control bolt 51 is pressed axially into the carburetor housing 1. The engine is started in this position of the actuating lever 57, which simultaneously is the partial gas position, whereby the pressure pulse from the crankcase chamber acts on the membrane 17 via the reversing or change-over valve. The control bolt 51, pushed axially into the valve chambers, opens the valve closure member 46 with its end 54, and, with its step or shoulder 55, which engages tightly against the sealing ring 56, closes the connection between the second valve chamber and the third valve chamber. The valve chamber 44, in this position, is connected with the valve chamber 45, so that the pressure pulse present via the passage 43 is conveyed via the passage 30 to the pressure chamber 27.

When the engine is started and has run-up to speed, the actuating lever 57 is pivoted further by further acceleration (i.e. further gas feed), as a result of which the extension 63 moves over the slope 58, which is provided over only half of the diameter of the head 57 in the direction of movement of arrow 60 of the actuating lever 57.

The control bolt 51, which is engaged with force in the rest position, returns again to its starting position. The extension 63 can be a structural part fastened to the actuating lever 57, or can be integral with the actuating lever 57.

The valve closure member 46 engages tightly against the sleeve 48 in the starting position illustrated in FIG. 3, while the step or shoulder 55 is lifted from the sealing ring 56 and connects the second valve chamber 45 with the third valve chamber 50. The pressure chamber 27 now communicates directly with the atmosphere. The actuating lever 57 at the same time is located behind the head 59 as seen in the direction of movement of the arrow 60, and therefore can be moved to the maximum deflection without actuation of the control bolt 51.

If the actuating lever 57 returns to its starting position counter to the direction of movement of arrow 60, the extension 63 which cooperates with the head 59, engages the edge 62 off-center relative to the point of rotation of the control bolt 51, thereby pivoting the control bolt 51 in the direction of arrow 61, so that the actuating lever 57 can return to its starting position without an enriching effect occurring. The extension 63 again moves over the control segment or slope 58, as described above, during renewed acceleration, i.e. rotation of the actuating lever 57 in the direction of arrow 60, whereby the pressure chamber 27 is again connected with the crankcase chamber, and a defined opening of the inlet valve 13 is achieved.

It is generally known that in the accelerating phase from idling to full load, the pressure in the intake pipe collapses, and a withdrawal or suctioning-off of fuel from the inlet passages 19, 20, 21 is impeded. The underpressure generated in the control chamber 4 then no longer suffices to open the inlet valve 13 in a defined manner, and fuel flow is disturbed. According to the present invention, the pressure pulse from the crankcase housing is directed to the membrane 17 in this critical phase, so that the inlet valve 13 is opened in a defined manner, and a fuel flow is assured. The internal combustion engine runs without disturbances in a clean and rapid manner to the maximum speeds.

Additional manipulations during starting or during acceleration of the engine are not necessary as a consequence of this integrated reversing or change-over valve. The manipulations during starting or restarting (hot start) of an internal combustion engine are considerably simplified.

The present invention is, of course, in no way restricted to the specific disclosure of the specification and drawings, but also encompasses any modifications within the scope of the appended claims.

What I claim is:

1. A carburetor for an internal combustion engine such as a small portable engine or the like, the engine having a crankcase housing, an intake pipe communicating with a combustion chamber of the engine, and a fuel supply line connected to a fuel pump, the carburetor comprising:

a carburetor housing including: a control chamber connected to said fuel supply line and inlet passages extending from said control chamber to said intake pipe;

inlet valve means for controlling fuel from said fuel pump to said control chamber, said inlet valve means being biased in the closed position;

membrane means associated with said carburetor housing for delimiting said control chamber and actuating said valve means in response to pressure pulses from said crankcase housing;

change-over valve means movable between a first position for causing said membrane means to communicate with the atmosphere and a second position for causing said membrane means to communicate with said crankcase housing thereby subjecting said membrane means to the pressure pulses generated in said crankcase housing;

biasing means for biasing said change-over valve means into said first position;

throttle means for adjusting the flow of air and fuel through said intake pipe;

actuating means operatively connecting said throttle means to said change-over valve means for actuating said change-over valve means to move the same from said first position to said second position as said throttle means is moved to accelerate said engine from start or no-load speed to full-load speed whereby pressure pulses are transmitted to said membrane means from said crankcase housing thereby actuating said inlet valve means to supply fuel to said control chamber sufficient to improve the fuel-air mixture supplied to the engine during acceleration; and, said actuating means involving further means to prevent said change-over valve means from being actuated when said throttle means is moved to return the operation of the engine to said no-load speed.

2. A carburetor for an internal combustion engine which includes a crankcase housing, an intake pipe communicating with a combustion chamber, and a fuel supply line connected to a fuel pump, said carburetor comprising:

a carburetor housing, which includes a control chamber in said fuel supply line, and which also includes inlet passages for connecting said control chamber with said intake pipe, with the volume of flow through said inlet passages being regulable;

an inlet valve in said fuel supply line for controlling fuel from said fuel pump to said control chamber, said inlet valve being biased in the closed position;

a membrane associated with said carburetor housing for delimiting said control chamber and opening said inlet valve;

a closure cover fastened on said carburetor housing and delimiting, along with said membrane, an equalizing chamber located on that side of said membrane remote from said control chamber, said equalizing chamber being a pressure chamber;

a change-over valve associated with said carburetor housing for selectively connecting said pressure chamber with said crankcase housing and with the atmosphere; and, means for holding said change-over valve in a starting position in which said pressure chamber is connected with said crankcase housing;

a throttle control rod for actuating said change-over valve, and means operatively connecting said control rod to said valve and positioning the valve to connect the pressure chamber with the crankcase during acceleration.

3. A carburetor for an internal combustion engine which includes a crankcase housing, an intake pipe communicating with a combustion chamber, and a fuel supply line connected to a fuel pump, said carburetor comprising:

a carburetor housing, which includes a control chamber in said fuel supply line, and which also includes inlet passages for connecting said control chamber with said intake pipe, with the volume of flow through said inlet passages being regulable;

an inlet valve in said fuel supply line for controlling fuel from said fuel pump to said control chamber, said inlet valve being biased in the closed position;

a membrane associated with said carburetor housing for delimiting said control chamber and opening said inlet valve;

a closure cover fastened on said carburetor housing and delimiting, along with said membrane, an equalizing chamber located on that side of said membrane remote from said control chamber, said equalizing chamber being a pressure chamber;

a change-over valve associated with said carburetor housing for selectively connecting said pressure chamber with said crankcase housing and with the atmosphere; and, a butterfly throttle valve in said intake pipe having a pivotable actuating lever having an extension; and in which said change-over valve includes a control bolt having a head which is partially located within the pivot range of said extension of said actuating lever.

4. A carburetor according to claim 3, in which said change-over valve further comprises three valve chambers, namely a first, second, and third valve chamber, which are arranged axially one after another, and which open into one another, with the transition between adjacent ones of said valve chambers being respectively adapted to be closed in an airtight manner by a valve controlled by said control bolt.

5. A carburetor according to claim 4, in which said valve from said first valve chamber to said second valve chamber is a first valve closure member which is biased in the closing direction and is held against a valve seat tightly arranged in said second valve chamber; in which said valve between said second valve chamber and said third valve chamber comprises a sealing ring arranged tightly in said second valve chamber, and a step of said control bolt, said step acting as a second valve closure member; and in which said valves are alternately actuatable, with said first valve chamber being connected with said crankcase housing, said second valve chamber being connected with said pressure chamber, and said third valve chamber being connected with the atmosphere.

6. A carburetor according to claim 5, in which that end of said control bolt which is located remote from said head thereof, and across from said first valve closure member, is constructed as an actuating push rod.

7. A carburetor according to claim 6, in which said head of said control bolt is located outside said carburetor housing and is provided with a stop corresponding to half the cross sectional surface of said head; with said stop having an inwardly located edge, and with that segment of said stop located in the pivot range of said extension of said actuating lever being provided with a slope which rises toward said inwardly located edge.

8. A carburetor according to claim 7, in which said control bolt is pivotable in the circumferential direction counter to a reset force, without axial displacement, by said extension of said actuating lever as said extension moves back toward the idling position.

* * * * *

UNITED STATES PATENT AND TRADEMARK OFFICE

CERTIFICATE OF CORRECTION

PATENT NO. : 4,455,266

DATED : June 19, 1984

INVENTOR(S) : Reinhard Gerhardy

It is certified that error appears in the above-identified patent and that said Letters Patent is hereby corrected as shown below:

In column 2, at line 35, add the following paragraph directly beneath the heading "Summary of the Invention":

-- An object of the present invention is to construct a carburetor in such a way that the starting and acceleration behavior of the fuel-supplied internal combustion engine is improved compared with the state of the art, and furthermore that the carburetor is less sensitive to changes in condition. --

In column 9, line 3: delete "involving" and substitute -- including -- therefor.

Signed and Sealed this

*Fifth* Day of *February 1985*

[SEAL]

*Attest:*

DONALD J. QUIGG

*Attesting Officer*

*Acting Commissioner of Patents and Trademarks*